United States Patent [19]

Sybertz et al.

[11] 4,405,092

[45] Sep. 20, 1983

[54] CUTTING DEVICE

[75] Inventors: Hans Sybertz; Ferdinand Sybertz, both of Hargesheim; Arnold Schmidt, Gutenberg, all of Fed. Rep. of Germany

[73] Assignee: Hombak Maschinenfabrik GmbH U. Co. KG, Bad Kreuznach, Fed. Rep. of Germany

[21] Appl. No.: 227,408

[22] Filed: Jan. 22, 1981

[30] Foreign Application Priority Data

Jan. 31, 1980 [DE] Fed. Rep. of Germany ... 8002428[U]

[51] Int. Cl.[3] ..... B02C 18/18

[52] U.S. Cl. ..... 241/294; 241/300

[58] Field of Search ..... 144/323, 162 R, 172; 241/294, 300, 277, 282.1, 282.2, 191, 192, 286, 292.1, 300.1

[56] References Cited

U.S. PATENT DOCUMENTS 3,865,164 2/1975 Sybertz ..... 241/294 X
3,904,139 9/1975 Maier et al. ..... 241/294 X
3,931,681 1/1976 Sybertz .

FOREIGN PATENT DOCUMENTS 2244077 3/1974 Fed. Rep. of Germany .
7522319 8/1976 Fed. Rep. of Germany .
2648231 10/1978 Fed. Rep. of Germany .
2736612 2/1979 Fed. Rep. of Germany ..... 241/294

*Primary Examiner*—Mark Rosenbaum
*Attorney, Agent, or Firm*—Michael J. Striker

[57] ABSTRACT

A cutting device has a rotatable body part and a plurality of cutting units each arranged in a recess on the periphery of the body part. Each unit has a cutting member abutting against an abutment face in the respective recess, the supporting member connected with the body part, and a holding member loosely abutting against the abutment face of the recess, wherein the cutting member is displaceably and fixably held on the holding member and loosely abuts with its front surface against the supporting member.

14 Claims, 4 Drawing Figures

CUTTING DEVICE

BACKGROUND OF THE INVENTION

The present invention relates to a cutting device, and more particularly to a cutting device for producing flat wooden chips.

Cutting devices of the above-mentioned general type are known in the art. A known cutting device has a shaft-like body part provided with a plurality of peripheral recesses each receiving a cutting unit. Each cutting unit includes a resharpenable cutting member, an abutment face provided in each recess and determining the length of the cutting member, an engaging or form-locking member which connects a supporting member for the cutting member with the body part, and a member which is displaceable under the action of centrifugal forces and acts upon the supporting member. Such a construction is disclosed, for example, in the German Auslegeschrift No. 2,648,231. In this cutting device, the resharpenable cutting member is connected with a supporting member by screws, and is displaceable relative to and fixable to the supporting member. The engaging member provided in the body part for the supporting member forms an abutment face for the latter and thereby determines the position of the cutting member connected with the supporting member. The cutting member itself is spaced by a small distance from the abutment face. The centrifugally actuated member acts upon the packet including the cutting member and the supporting member and presses the cutting member by its rear face against the inner face of the peripheral recess formed in the body part. The above-described construction possesses considerable disadvantages. For resharpening the cutting member, the packet composed of the cutting member and the supporting member must be withdrawn from the body part and respectively manipulated with. This handling is, because of the high weight of the supporting member, expensive and difficult. Another disadvantage of this construction is that during the exchange of the above-mentioned packet, the centrifugally actuated member must be pressed so deep that the supporting member can be pulled from its engaging member. Finally, still a further disadvantage of this construction is that the engaging member must be thoroughly cleaned before the insertion of the packet into the recess.

SUMMARY OF THE INVENTION

Accordingly, it is an object of the present invention to provide a cutting device which avoids the disadvantages of the prior art.

More particularly, it is an object of the present invention to provide a cutting device which is easier to manipulate and to adjust.

In keeping with these objects, and with others which will become apparent hereinafter, one feature of the present invention resides, briefly stated, in a cutting device having a rotatable body part and a plurality of cutting units each arranged in a respective one of recesses provided on a periphery of the body part, wherein a supporting member of each unit is connected with the body part, a holding member is provided which loosely abut against an abutment face of a respective recess of the body part, and the cutting member is displaceably and fixedly held on the holding member and loosely abuts with its front surface against the supporting member.

When the cutting device is designed in accordance with the present invention, the supporting member remains in the body part during exchange or resharpening of the cutting member and is retained in its engaging or form-locking member. All the cutting member with its holding member are to be manipulated. The holding member can be constituted of a thin material; for example, it may have a thickness of substantially 1.5 mm. Thereby a considerable weight decrease and corresponding considerably facilitated manipulation with the cutting member during disassembling or exchange of the latter, is attained.

The assembly which includes the holding member and the cutting member lies, on the one hand, loosely against the supporting member and, on the other hand, loosely on the abutment face. For disassembling this assembly, it suffices to displace the centrifugally actuated member only by a small distance and to pull the above-mentioned assembly from its recess without difficulties.

The holding member which extends over the length of the cutting member needs only a short face for abutment against the abutment face of the recess of the body part. Thereby even in condition of dirtying, exact abutment can be attained in a relatively simple manner, and an exact position of the cutting member is also attained. The cutting member itself can be spaced from the above-mentioned abutment face by a small distance. Since the supporting member is not to be pulled from its engaging member, the above-mentioned problem of dirtying is thereby eliminated.

The cutting member and the holding member can be connected with one another by tightening screws which extend through a longitudinal opening in the holding member. The longitudinal opening can extend approximately normal to the longitudinal axis of the holding member, or can be somewhat inclined relative to the same.

In accordance with another feature of the present invention, the cutting member may have two threaded openings in which a tightening screw can be alternatively received. When the displacement stroke between the cutting member and the holding member is used up by the length of the above-mentioned elongated opening, the cutting member can be further resharpened, inasmuch as the tightening screw can be screwed into the other threaded opening.

In accordance with yet another feature of the present invention, each cutting unit is provided with a wearing member having a peripherally open insertion slot, and the cutting member abuts by its rear surface against the wearing member, whereas a holding portion of the holding member and the tightening screw are received in the insertion slot. The supporting member which extends over the length of the cutting member can thereby be formed relatively small. The above-mentioned elongated slot for mounting the holding member with the cutting member extends approximately normal to the above-mentioned holding portion of the holding member which, in turn, can be respectively small. When the assembly including the holding portion and the cutting member is inserted, after resharpening of the cutting member and the required adjustment between the cutting member and the holding member, again into the body part, the assembly can be easily inserted with abutment of the front face of the cutting member against the supporting member. The above-mentioned holding portion with the upwardly extending heads of the tightening screws extends into the insertion slot of the wearing member.

For preventing excessive dirtying of the outwardly open insertion slot, it is advantageous to design the cutting device so that the free outer end of each holding section of the holding member is bent to overlap approximately the depth of the insertion slot and to close the latter from outside.

Still a further feature of the present invention is that the supporting member has a peripheral portion which forms a chip flow face, and this portion is engaged over by a section of the centrifugally actuated member, the section extending to the front surface of the cutting member. This makes simpler the means for fixing and adjusting the cutting member.

The German Gebrauchsmuster No. 7,522,319 shows a cutting device for producing flat chips in which each cutting unit inserted in the respective recess has a resharpenable cutting member, a supporting member connected with the body part via an engaging member, and a centrifugally acutated member acting upon the supporting member. The centrifugally actuated member has a portion which serves to support the wooden workpiece, whereas the cutting member with its front face loosely abuts against the supporting member having a radially outer longitudinal edge which forms a chip flow face. In such a construction, the cutting member is held in force-transmitting manner. Means for detetermining the cutting member projecting length in the working position of the cutting member is not provided in the bottom part. As disclosed in this Gebrauchsmuster, the adjustment of the cutting member is performed in accordance with the German Offenlegungsschrift No. 2,244,077. Here, the entire cutting member with its projecting length is clamped so that it is greater than the desired projecting length in the working position of the cutting member. Subsequently, the cutting member is pressed with the aid of a special arrangement to the desired projecting length into the body part. In the embodiment shown in FIG. 2 of the German Gebrauchsmuster No. 7,522,319, the supporting member with its outer edge is flush with the outer surface of the body part. The outer longitudinal edge of the supporting member has a portion for supporting the wooden workpiece which is in alignment with the respective portions of the centrifugally actuated member to form chip flow faces therebetween.

The disadvantage of the known constructions resides in the fact that it has a complicated shape and thereby requires expensive manufacture of the supporting member. Since the supporting member with its web-shaped projection extends to the outer surface of the body part, and the members as a rule are inclined to the axis of the body part, the supporting member must be twisted over its length in correspondence with the outer surface of the body part. This leads to a complicated construction of the supporting member, which requires expensive automatic copying machines. This construction also possesses a disadvantage in the fact that the adjustment of the cutting member in accordance with the desired projecting length in its working position can be performed only with the aid of a special rolling or pressing arrangement, inasmuch as the body portion itself does not have an abutment face for determination of the projecting length of the cutting member.

The inventive construction of the supporting member leads therefore to enormous simplification in the manufacture of the supporting member. Since the supporting member no longer extends to the outer surface of the body part, all abutment longitudinal edges are parallel to one another, so that the supporting member can be formed as a rolled shaped member. The thus obtained reduction of the manufacturing expenses is enormous. The functions of the known web-like projections on the supporting member are now performed by the centrifugally actuated member which has the portion for supporting the wooden workpiece extending directly to the front face of the cutting member. The upper longitudinal edge of the supporting member can thereby be formed smoothly.

Since the centrifugally actuated member is now subjected to wear during the operation of the cutting device, it is advantageous when the above-mentioned portion of the centrifugally actuated member, or at least its part, is formed as an exchangeable wearing part.

The handling of the cutting device is further improved when the supporting member is provided with a pressure spring which acts upon the supporting member in its opening position. The spring can engage in a recess of the supporting member and retain the latter in the engaging member so as to perform double functions.

For further reducing the weight and the manufacturing expense of the supporting member, the supporting member may be formed relatively small and mounted on the spring to be retained by the latter.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
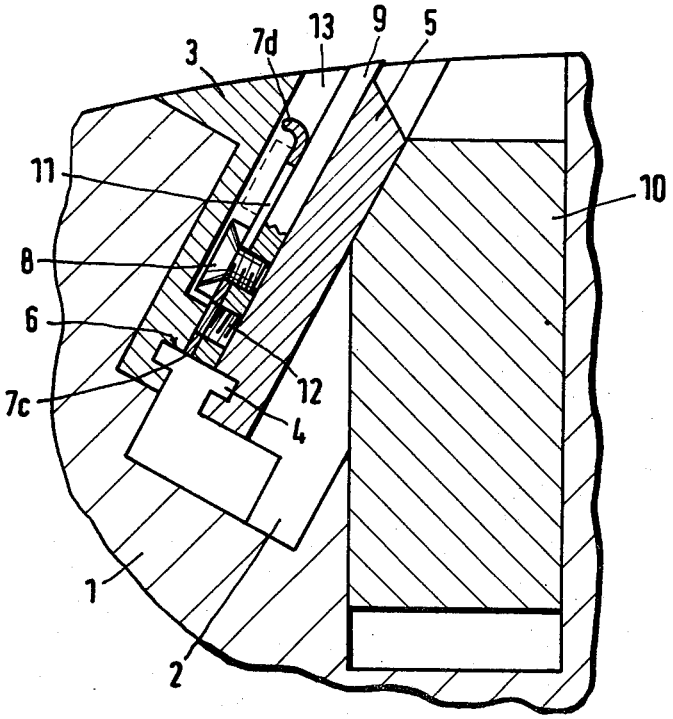
FIG. 1 is a view showing a section of a cutting device in accordance with the present invention.

A cutting device shown in FIG. 1 has a body part which is identified by reference numeral 1 and provided with a plurality of recesses 2, one of which is shown in the drawing.

A wearing member 3 is fixedly connected with the body part 1 and is flush with the outer surface of the latter. An engaging or form-locking member 4 is also fixedly connected with the body part 1. The engaging member 4 is provided for connecting a supporting member 5 with the body part 1. The engaging member 4 has an abutment face 6 against which a holding member 7 loosely abuts. The holding member 7 is connected by screws 8 with a cutting member 9. The cutting member 9 loosely abuts with its front face against the supporting member 5. A centrifugally actuated member 10 acts upon the supporting member 5 so that the cutting member 9 abuts by its rear face against the wearing member 3.

Tightening screws 8 extend through an elongated opening 11 of the holding member 7 so that the cutting member 9 is displaceable in approximately radial direction relative to the associated holding member 7 and fixed to the latter in the desired position. In order to increase the displacement and thereby provide for more frequent resharpening of the cutting member, the cutting member has two threaded openings 12 for the tightening screw 8.

Figure 2:
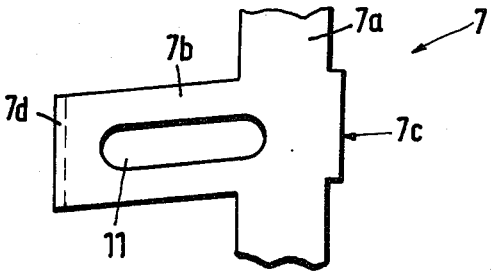
FIG. 2 is a view showing a holding member of the cutting device in accordance with the present invention.

As can be seen from FIG. 2, the holding member 7 includes a relatively small portion 7*a* which extends over the length of the cutting member 9, and a holding portion 7*b* provided on the portion 7*a* and having the above-mentioned elongated opening 11. The portion 7*a* of the holding member 7 has a relatively short abutment face 7*c* with which the holding member 7 abuts against the abutment face 6.

The wearing member 3 has an insertion slot 13 which is open in direction towards the periphery of the body part. The insertion slot 13 serves for receiving the holding portion 7*b* of the holding member 7, as well as the head of the tightening screw 8. For protecting the insertion slot 13 outwardly from dirt which can penetrate into the same, a free outer end section 7*d* of each holding portion 7*b* is wound approximately in correspondence with the depth of the insertion slot 13.

The insertion slot 13 is not considerably wider than the holding portion 7*b*. Basically it would be possible to close the insertion slot at the outer surface of the body part. However, it would be necessary in this case to press the centrifugally actuated member 10 deeper for removal of the cutting member.

Figure 4:
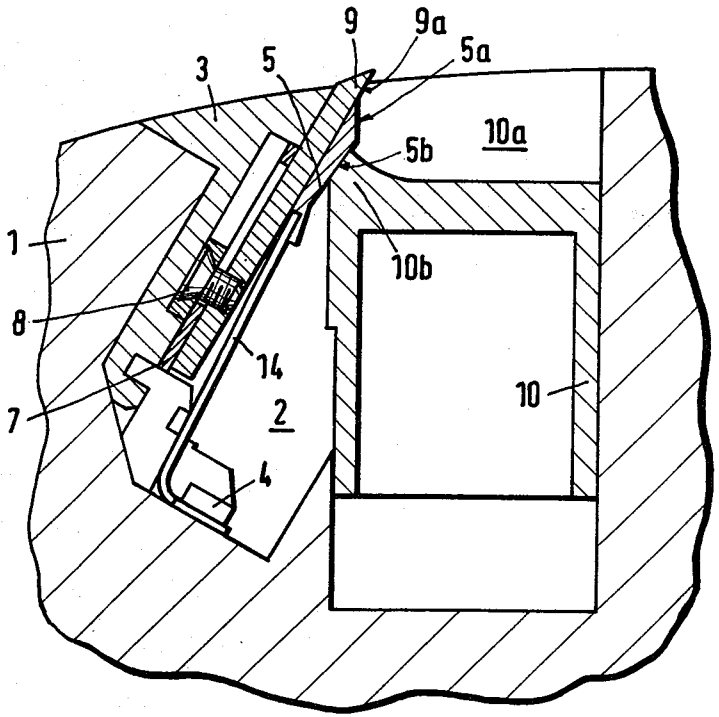
FIG. 4 is a view showing a cutting device in accordance with still another embodiment of the present invention.
Figure 3:
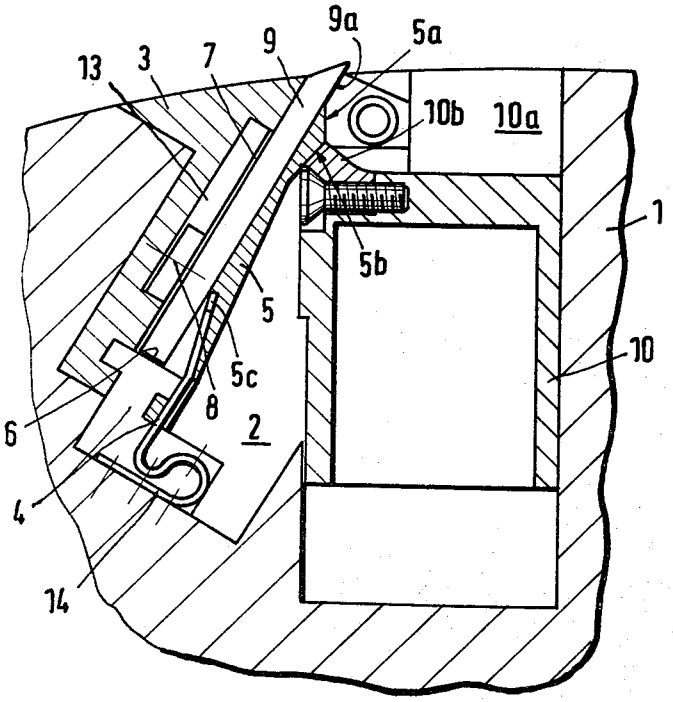
FIG. 3 is a view showing a cutting device in accordance with another embodiment of the present invention.

Cutting devices shown in FIGS. 3 and 4 also have the body part 1 with the peripheral recesses 2, of which only one recess is shown in the drawings. The wearing member 3 is fixedly connected with the body part 1 and is flush with the outer surface of the latter. The engaging or form-locking member 4 connects the supporting member 5 with the body part 1. The engaging member 4 has an abutment face 6, and the holding member 7 loosely abuts against the latter. The holding member 7 is connected by tightening screws 8 not shown with the cutting member 9. The cutting member 9 loosely abuts by its front surface 9*a* against the supporting member 5. The centrifugally actuated member 10 acts upon the supporting member 5 so that the cutting member 9 with its rear face abuts against the wearing member 3. The not shown tightening screws for the cutting member 9 can extend through the elongated opening of the holding member 7 so that the cutting member 9 can be approximately radially displaceable relative to the holding member 7 and fixed to the latter in the desired position. In order to increase this displacement, and to provide more frequent resharpening of the cutting member, the cutting member 9 can be provided with two threaded openings located one above the other, for the tightening screws. The wearing member 3 has the insertion slot 13 for receiving the holding member 7 and its tightening screw.

The supporting member 5 is formed as a simple rolled shaped member. The radially outer longitudinal edge of the supporting member forms a chip flow face 5*a* which is uninterrupted over the length of the supporting member. The chip flow face 5*a* is engaged over by a portion 10*a* of the centrifugally actuated member 10. The portion 10*a* serves for supporting a wooden workpiece. The centrifugally actuated member 10 extends to the front face 9*a* of the cutting member 9. The centrifugally actuated member 10 abuts only with its small pressure projections 10*a* against the supporting member 5. An abutment face 5*b* of the supporting member 5 extends at an acute angle to the front face 9*a* of the cutting member 9. As can be seen from FIG. 3, the portion 10*a* of the centrifugally actuated member or its part is formed as an exchangeable wearing part.

In the embodiment shown in FIG. 3, a spring 14 acts upon the supporting member 5 in its opening position. The spring 14 engages in a recess 5*c* of the supporting member 5 and fixes the latter in the engaging member 4. The spring 14 performs a double function. Since the recess 5*c* in the supporting member 5 is formed as a downwardly open insertion slot, and the supporting member 5 with its rounded projection engages in the respective recess of the form-locking part screwed with the body paart 1, the spring 14 and the engaging part 4 together form a snap-like connection. In order to perform mounting, after the insertion of the spring 14, the supporting member 5 with its recess 5*c* is fitted over the spring from above and pressed downwardly until it engages with its projection with the engaging member.

In the embodiment shown in FIG. 4, the supporting member 5 is considerably smaller than in the embodiment of FIG. 3. The small supporting member 5 practically embraces only the chip flow face 5*a* and the abutment face 5*b* for the pressing projection 10*b* of the centrifugally actuated member 10. The lower edge of the small supporting member 5 is mounted on the round spring 14 which, in turn, is mounted by its lower bent end on the body part 1. When the supporting member 5 is long, several springs 14 arranged at a distance from one another can be provided.

It will be understood that each of the elements described above, or two or more together, may also find a useful application in other types of constructions differing from the types described above.

While the invention has been illustrated and described as embodied in a cutting device for producing flat wooden chips, it is not intended to be limited to the details shown, since various modifications and structural changes may be made without departing in any way from the spirit of the present invention.

Without further analysis the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cutting device, comprising a rotatable body part having an axis of rotation and a periphery which is provided with a plurality of recesses spaced from one another and has an abutment face in each of said recesses; and a plurality of cutting units each arranged in a respective one of said recesses of said body part, each of said cutting units including a resharpenable cutting member having a front surface, a supporting member which supports said cutting member and is connected with said body part, a member displaceable under the action of centrifugal forces and acting upon said supporting member to clamp the above-mentioned members in the same recess of said body part, a holding member loosely abutting against the abutment face of the same recess of said body part and arranged so that said cutting member is substantially radially displaceably and fixedly held on said holding member and loosely abuts with its front surface against said supporting member, and means for connecting said cutting member with said holding member.

2. A cutting device as defined in claim 1, wherein each of said cutting units includes an engaging member which is connected with said body part and connects said supporting member of the same cutting unit with said body part.

3. A cutting device as defined in claim 1, wherein said centrifugally displaceable member has a section extending to said front surface of said cutting member and arranged to support a workpiece, said supporting member having a peripheral portion which forms a chip flow face and is engaged over by said section of said displaceable member of the same cutting unit.

4. A cutting device as defined in claim 3, wherein at least a part of said section of said centrifugally displaceable member of each cutting unit is formed as an exchangeable wearing part.

5. A cutting device as defined in claim 1, wherein each of said cutting units includes a spring which acts upon said supporting member in direction out of the respective recess of said body part.

6. A cutting device as defined in claim 5, wherein each of said cutting units has an engaging member which is connected with said body part, each of said supporting members having a recess in which said spring engages and connects said supporting member with said engaging member of the same cutting unit.

7. A cutting device as defined in claim 5, wherein said supporting member is small as compared with said cutting member of the respective cutting unit, said small supporting member being mounted on and supported by said spring of the same cutting unit.

8. A cutting device as defined in claim 1, wherein said supporting member of each of said cutting units is formed as a rolled shaped member.

9. A cutting device, comprising a rotatable body part having an axis of rotation and a periphery which is provided with a plurality of recesses spaced from one another and has an abutment face in each of said recesses; and a plurality of cutting units each arranged in a respective one of said recesses of said body part, each of said cutting units including a resharpenable elongated cutting member having a front surface, a supporting member which supports said cutting member and is connected with said body part, a member displaceable under the action of centrifugal forces and acting upon said supporting member to clamp the above-mentioned members in the same recess of said body part, a holding member loosely abutting against the abutment face of the same recess of said body part and arranged so that said cutting member is substantially radially displaceably and fixedly held on said holding member and loosely abuts with its front surface against said supporting member, wherein said holding member has a first longer portion extending in a direction of elongation of said cutting member and a shorter portion abutting against the abutment face of said body part in the respective recess, and means for connecting said cutting member with said holding member, said connecting means including an elongated opening provided in said holding member and a tightening screw connected with said cutting member and extending through said elongated opening of said holding member.

10. A cutting device, comprising a rotatable body part having an axis of rotation and a periphery which is provided with a plurality of recesses spaced from one another and has an abutment face in each of said recesses; and a plurality of cutting units each arranged in a respective one of said recesses of said body part, each of said cutting units including a resharpenable elongated cutting member having a front surface, a supporting member which supports said cutting member and is connected with said body part, a member displaceable under the action of centrifugal forces and acting upon said supporting member to clamp the above-mentioned members in the same recess of said body part, a holding member loosely abutting against the abutment face of the same recess of said body part and arranged so that said cutting member is substantially radially displaceably and fixably held on said holding member and loosely abuts with its front surface against said supporting member, wherein said holding member has a first longer portion extending in a direction of elongation of said cutting member and a shorter portion abutting against the abutment face of said body part in the respective recess, and means for connecting said cutting member with said holding member, said connecting means including at least two threaded openings provided in said cutting member and spaced from one another, and a tightening screw connected with said holding member and alternately threadable in each of said threaded openings of said cutting member.

11. A cutting device, comprising a rotatable body part having an axis of rotation and a periphery which is provided with a plurality of recesses spaced from one another and has an abutment face in each of said recesses; and a plurality of cutting units each arranged in a respective one of said recesses of said body part, each of said cutting units including a resharpenable cutting member having a front surface, a supporting member which supports said cutting member and is connected with said body part, a member displaceable under the action of centrifugal forces and acting upon said supporting member to clamp the above-mentioned members in the same recess of said body part, a holding member loosely abutting against the abutment face of the same recess of said body part and arranged so that said cutting member is substantially radially displaceably and fixably held on said holding member and loosely abuts with its front surface against said supporting member, and a wearing member having a peripherally open insertion slot, said cutting member of each of said cutting units having a rear surface abutting against said wearing member, and said holding member having a holding portion received in said insertion slot of said cutting member of the same cutting unit.

12. A cutting device as defined in claim 11, wherein said means for connecting said cutting member with said holding member of each cutting unit is also received in said insertion slot of said wearing member of the same cutting unit.

13. A cutting device as defined in claim 11, wherein said insertion slot of said wearing member has a predetermined depth, said holding portion of said holding member having a peripheral section which is bent so as to substantially overlap the depth of said insertion slot of said wearing member of the same cutting unit.

14. A cutting device, comprising a rotatable body part having an axis of rotation and a periphery which is provided with a plurality of recesses spaced from one another and has an abutment face in each of said recesses; and a plurality of cutting units each arranged in a respective one of said recesses of said body part, each of said cutting units including a resharpenable cutting member having a front surface, a supporting member which supports said cutting member and is connected with said body part, a member displaceable under the action of centrifugal forces and acting upon said supporting member to clamp the above-mentioned members in the same recess of said body part, a holding member loosely abutting against the abutment face of the same recess of said body part and arranged so that said cutting member is substantially radially displaceably and fixably held on said holding member and loosely abuts with its front surface against said supporting member, means for connecting said cutting member with said holding member and including an elongated opening provided in said holding member and a tightening screw connected with said cutting member and extending through said elongated opening of said holding member.

* * * * *